US007836841B2

(12) United States Patent
Tung

(10) Patent No.: US 7,836,841 B2
(45) Date of Patent: Nov. 23, 2010

(54) MULTIFUNCTION ANCHOR

(75) Inventor: Chin-Chung Tung, Taipei Hsien (TW)

(73) Assignee: Marine Town Inc., Taipei Hsien (TW)

( * ) Notice: Subject to any disclaimer, the term of this patent is extended or adjusted under 35 U.S.C. 154(b) by 0 days.

(21) Appl. No.: 12/378,700

(22) Filed: Feb. 18, 2009

(65) Prior Publication Data

US 2010/0206211 A1 Aug. 19, 2010

(51) Int. Cl.
*B63B 21/24* (2006.01)

(52) U.S. Cl. ..... 114/303

(58) Field of Classification Search ..... 114/297, 114/299, 303

See application file for complete search history.

(56) References Cited

U.S. PATENT DOCUMENTS

| | | | | | |
|---|---|---|---|---|---|
| 1,583,795 | A | * | 5/1926 | Pasturzak | 43/44.96 |
| 2,863,415 | A | * | 12/1958 | Schofield | 114/295 |
| 3,285,218 | A | * | 11/1966 | Gilbertson et al. | 114/303 |
| 4,403,564 | A | * | 9/1983 | Garvin | 114/299 |
| 4,823,721 | A | * | 4/1989 | Pekny | 114/303 |
| 5,592,896 | A | * | 1/1997 | Cassidy | 114/303 |

* cited by examiner

*Primary Examiner*—Stephen Avila
(74) *Attorney, Agent, or Firm*—Charles E. Baxley

(57) ABSTRACT

A multifunction anchor comprises an anchor shank to selectively work with one of a dual-fin fluke set, a four-leaf fluke set, and the spear fluke set. A user can choose one of the fluke sets that suits current anchoring conditions to assemble with the anchor shank to anchor a vessel.

12 Claims, 11 Drawing Sheets

MULTIFUNCTION ANCHOR

BACKGROUND OF THE INVENTION

1. Technical Field

The present invention relates to an anchor serving to berth a vessel at a predetermined anchorage by preventing the vessel from floating away with water currents.

2. Description of Related Art

It is a common solution to make a vessel stay at a position by casting to the bottom of sea an anchor that is associated with an anchor chock settled on the vessel through an anchor chain or anchor cable. To structurally describe the known anchor, it comprises an anchor shank bound with an anchor chain or anchor cable, and flukes fixed on the anchor shank. The flukes typically come in a pair arranged at opposite sides of the anchor shank. When the anchor is dropped into water and dragged along the ground underwater, the flukes will bite into the ground and firmly retain the vessel at the predetermined anchorage, thereby securing the vessel from floating away with water currents.

For suiting various anchoring environments, in consideration of currents, the weather, the geology of anchorage grounds, etc, a vessel may be equipped with anchors on the bow or on the stern or on both the bow and stern. To optimize the anchoring efficiency, it is desired that anchors be designed to cater for different anchoring environments.

SUMMARY OF THE INVENTION

The primary objective of the present invention is to provide a multifunction anchor. The anchor has an anchor shank to be assembled with fluke sets of multiple types through assembling elements of multiple types so that an operator is allowed to choose the fluke set that best suits the present anchoring environment and assemble the chosen fluke set with the anchor shank, thereby optimizing anchoring efficiency of the disclosed anchor.

The multifunction anchor comprises:

an anchor shank, having a first end and a second end positioned opposite at an axis thereof, wherein the first end comprises a first connecting ring while the second end is formed as a reduced-diameter section and comprises a second connecting ring fixed to a center of the second end; and a fluke set, having an assembling unit fixedly attached to the second end of the anchor shank and a fluke body attached to the assembling unit.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENTS

Figure 1:
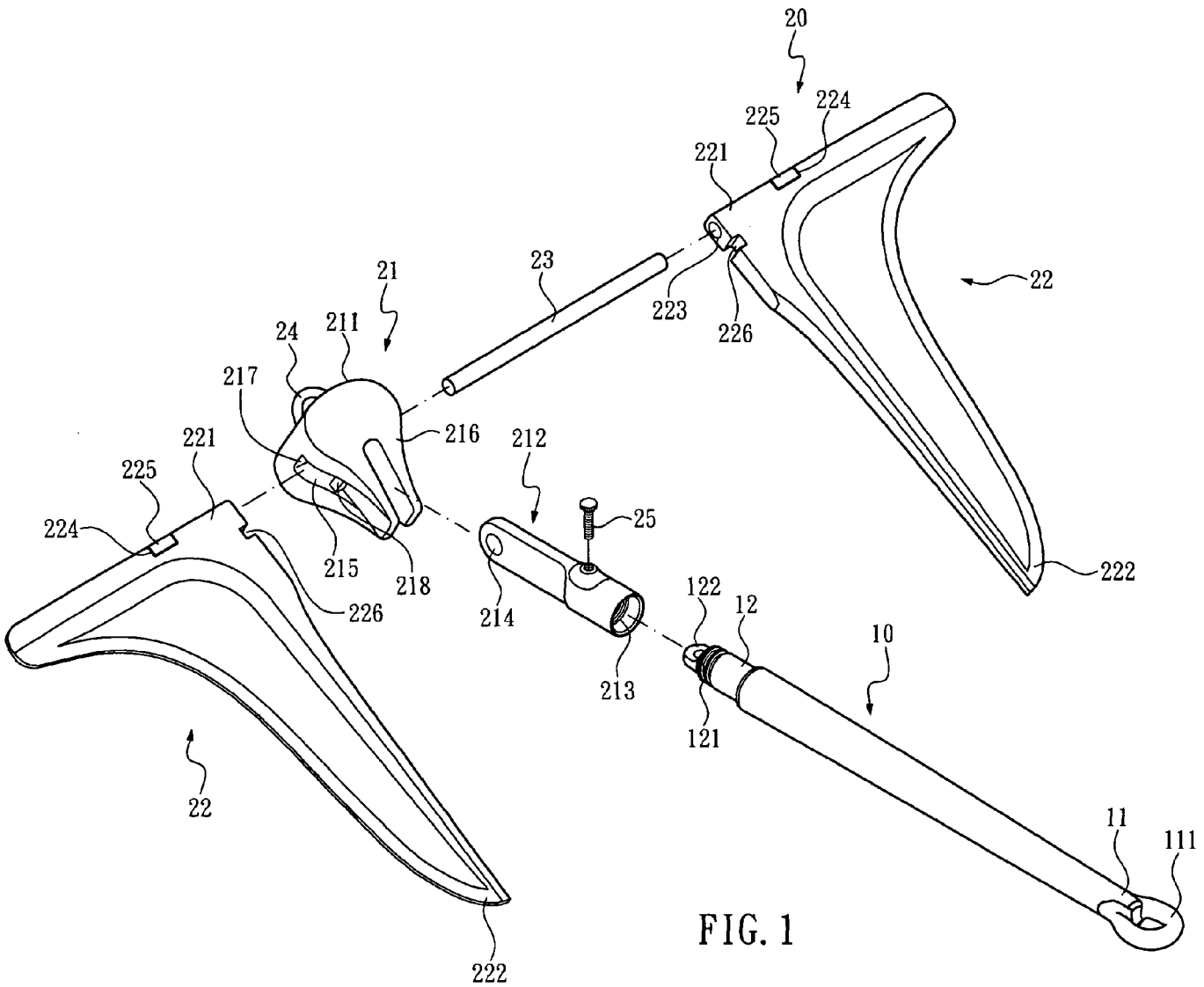
FIG. 1 is an exploded view of an anchor shank and a dual-fin fluke set according to the present invention.
Figure 2:
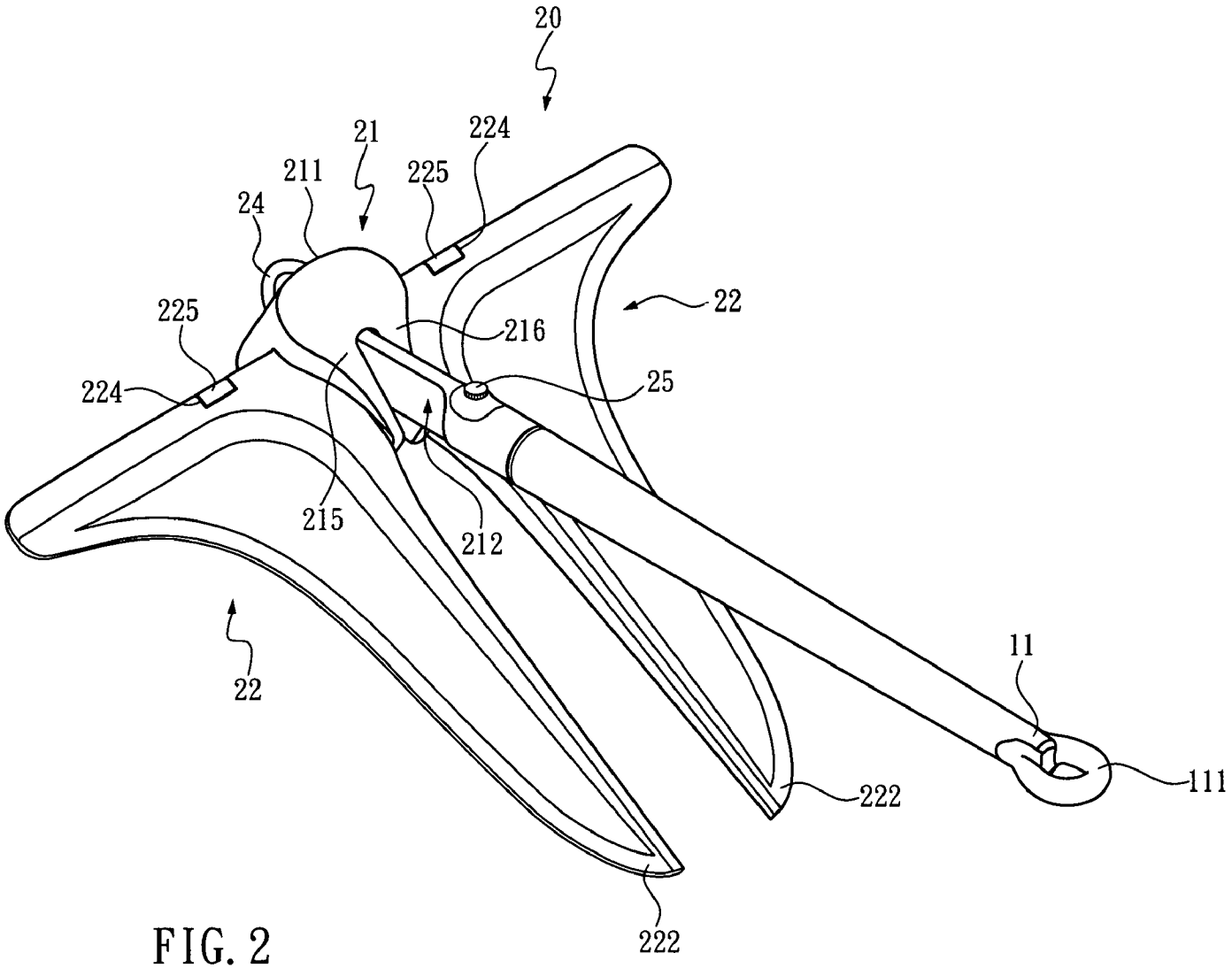
FIG. 2 is a perspective drawing showing the anchor shank and the dual-fin fluke set assembled.
Figure 6:
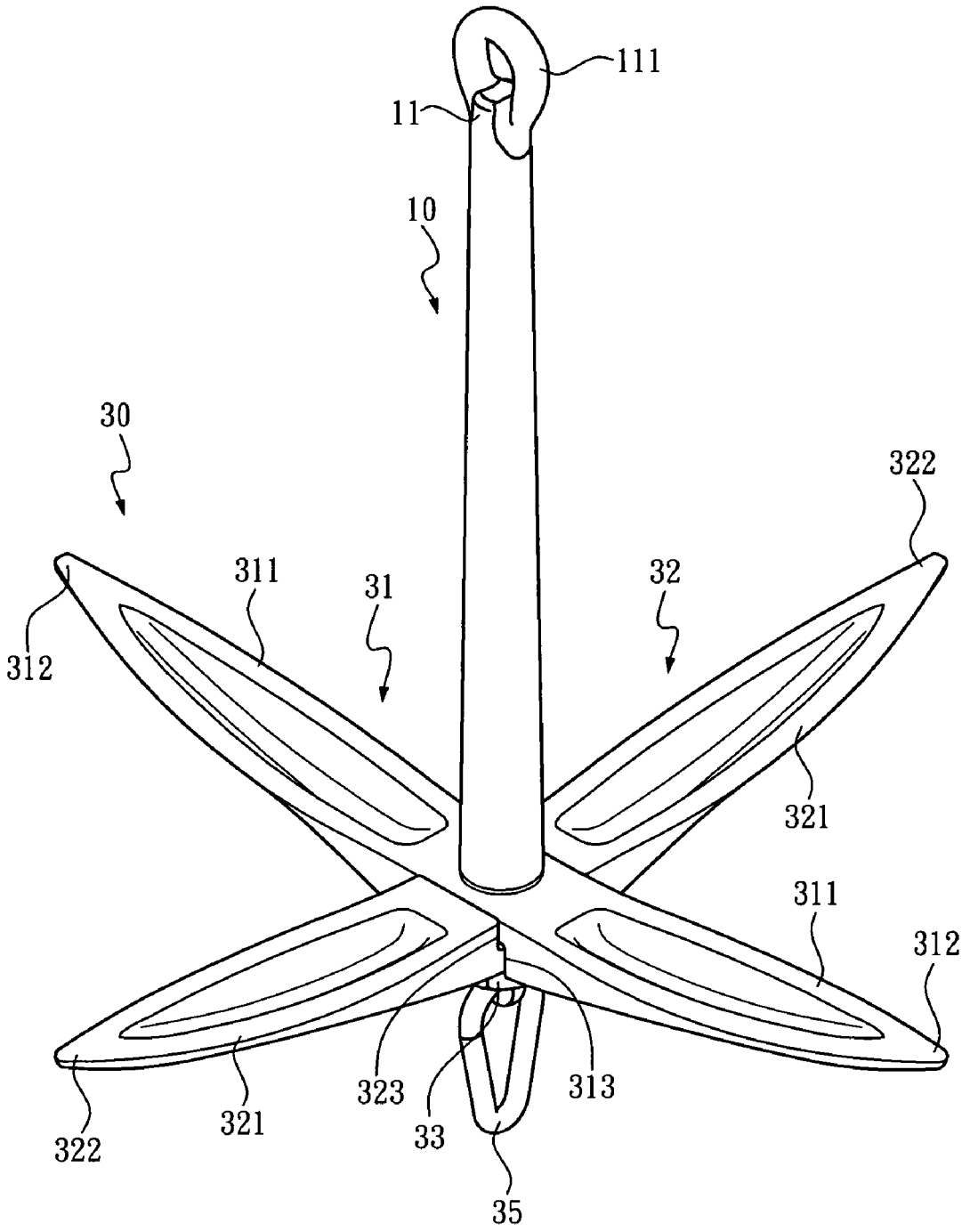
FIG. 6 is a perspective drawing showing the anchor shank and the four-leaf fluke set assembled.
Figure 9:
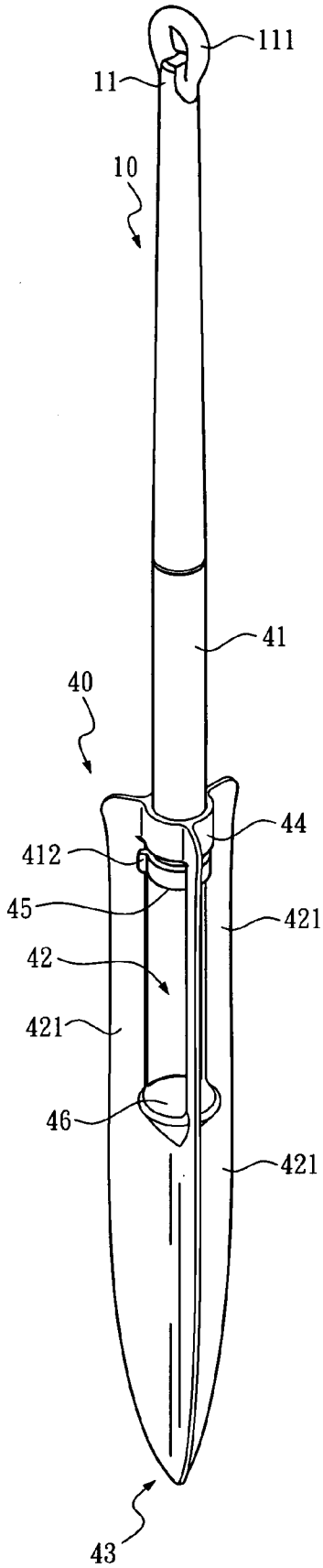
FIG. 9 is a perspective drawing showing the anchor shank and the spear fluke set assembled.
Figure 10:
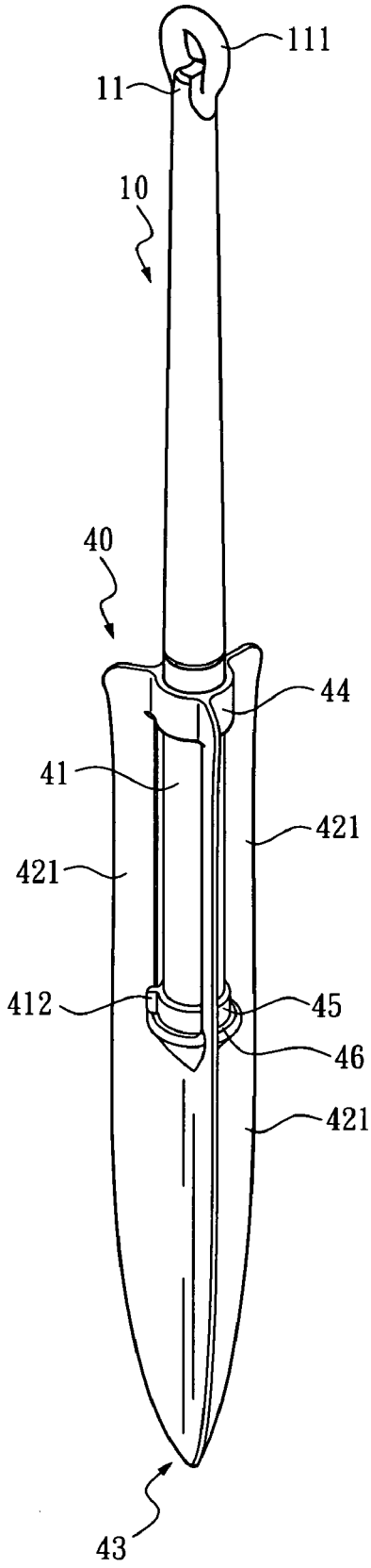
FIG. 10 is a schematic drawing of the assembled anchor shank and spear fluke set.
Figure 11:
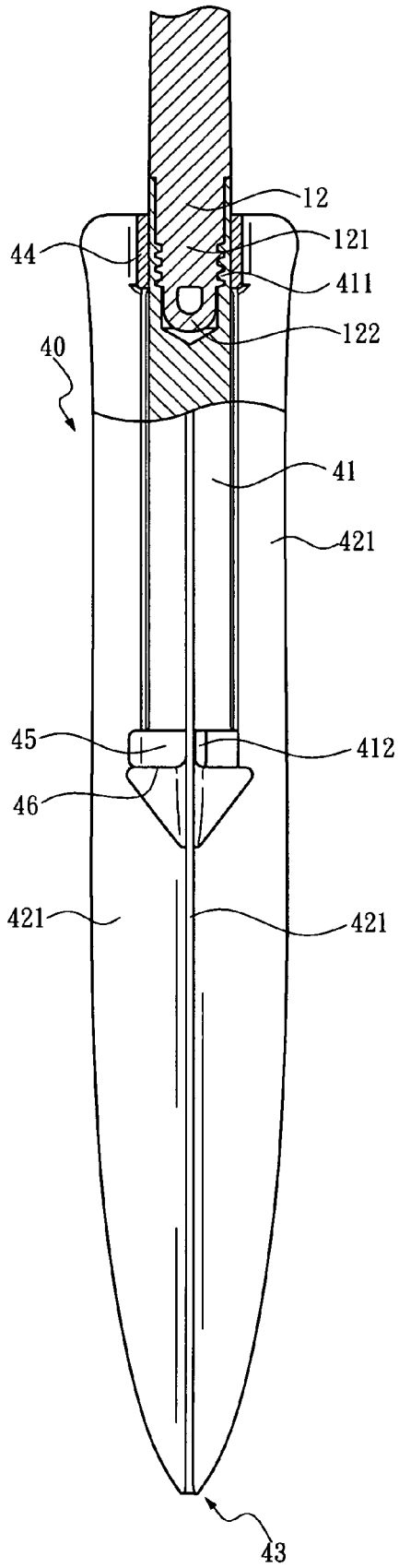
FIG. 11 is a sectional view of the assembled anchor shank and spear fluke set.

Please refer to FIGS. 2, 6, and 9 for the multifunction anchor of the present invention. The multifunction anchor primarily comprises an anchor shank 10 and a fluke set, which will be described in detail below.

The anchor shank 10 has a straight body. Two axially opposite ends of the anchor shank 10 are herein defined as a first end 11 and a second end 12, respectively. The first end 111 comprises a first connecting ring 111 to be bound with an anchor chain, which is a known article and is not shown in the drawings. The second end 12 is formed as a reduced-diameter section that includes a threaded portion 121 and comprises a second connecting ring 122 fixed at a center the second end 12.

The fluke set has an assembling unit fixedly attached to the second end 12 of the anchor shank 10 and a fluke body attached to the assembling unit. According to the present invention, the fluke set may be any of a dual-fin fluke set 20, a four-leaf fluke set 30, and a spear fluke set 40. One of the dual-fin fluke set 20, the four-leaf fluke set 30 and the spear fluke set 40 is selectively assembled with the anchor shank 10. The fluke body of the dual-fin fluke set 20 comprises two fins 22 connected to two sides of the assembling unit 21 of the dual-fin fluke set 20. The fluke body of the four-leaf fluke set 30 comprises a first arm 31 and a second arm 32 fixed to the second end 12 of the anchor shank 10 by the assembling unit 33. The fluke body of the spear fluke set 40 is structurally a spear having plural edges 421 that are radially arranged.

The dual-fin fluke set 20, the four-leaf fluke set 30 and the spear fluke set 40 will be further illustrated in the following paragraphs.

As shown in FIGS. 1 through 4, the assembling unit 21 of the dual-fin fluke set 20 comprises a connector 211 and a connecting shaft 212 that are pivotally connected with each other. The connecting shaft 212 has a first end and a second end positioned opposite at an axis thereof. The first end includes a threaded portion 213 to be coupled with the threaded portion 121 of the anchor shank 10. The second end has a radially extending through hole 214. A screw 25 radially passes through the first end of the connecting shaft 212 and pierces into the second connecting ring 122 of the anchor shank 10 so as to connect the connecting shaft 212 and the anchor shank 10 with enhanced firmness.

The connector 211 has a pin 23 passing a left portion 215 and a right portion 216 of the connector 211. The second end of the connecting shaft 212 is sandwiched between the left portion 215 and the right portion 216 so that the pin 23 passing through the through hole 214 pivotally connects the connector 211 and the connecting shaft 212.

Each of the two fins 22 is approximately of an L shape. The fin 22 includes a base portion 221 and has its thickness gradually reduced from the base portion 221 to two apexes of the L shape. An inserting end 222 is thus formed on the fin 22 at one of the apexes relatively far from the assembling unit 21. A pin hole 223 is provided at the base portion 221 of the fin 22 for receiving either end of the pin 23. An opening 224 is formed at a side of the fin 22 corresponding to the pin hole 223 to be filled with a packing element 225 so that the packing element 225 presses against a periphery of the pin 23, thereby fastening the fin 22 on the pin 23.

Each of the left portion 215 and the right portion 216 has a recess 217 for receiving the base portion 221 of the corresponding fin 22. The recess 217 and the base portion 221 are provided with a protrusion 218 and a notch 226, respectively, wherein the protrusion 218 and the notch 226 are designed to couple with each other. Thereby, the two fins 22 can be positioned in the left portion 215 and the right portion 216 of the connector 21.

Figure 3:
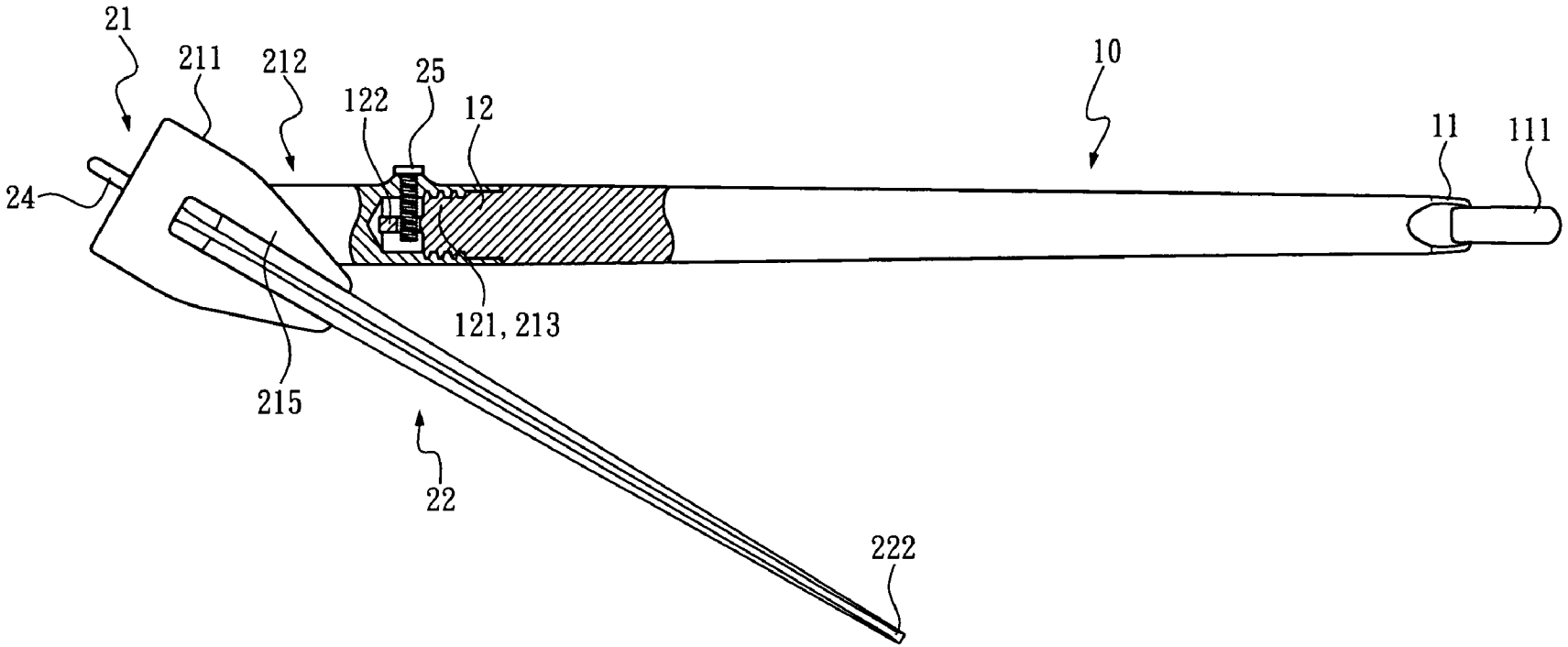
FIG. 3 is a lateral view of the assembled anchor shank and dual-fin fluke set.
Figure 4:
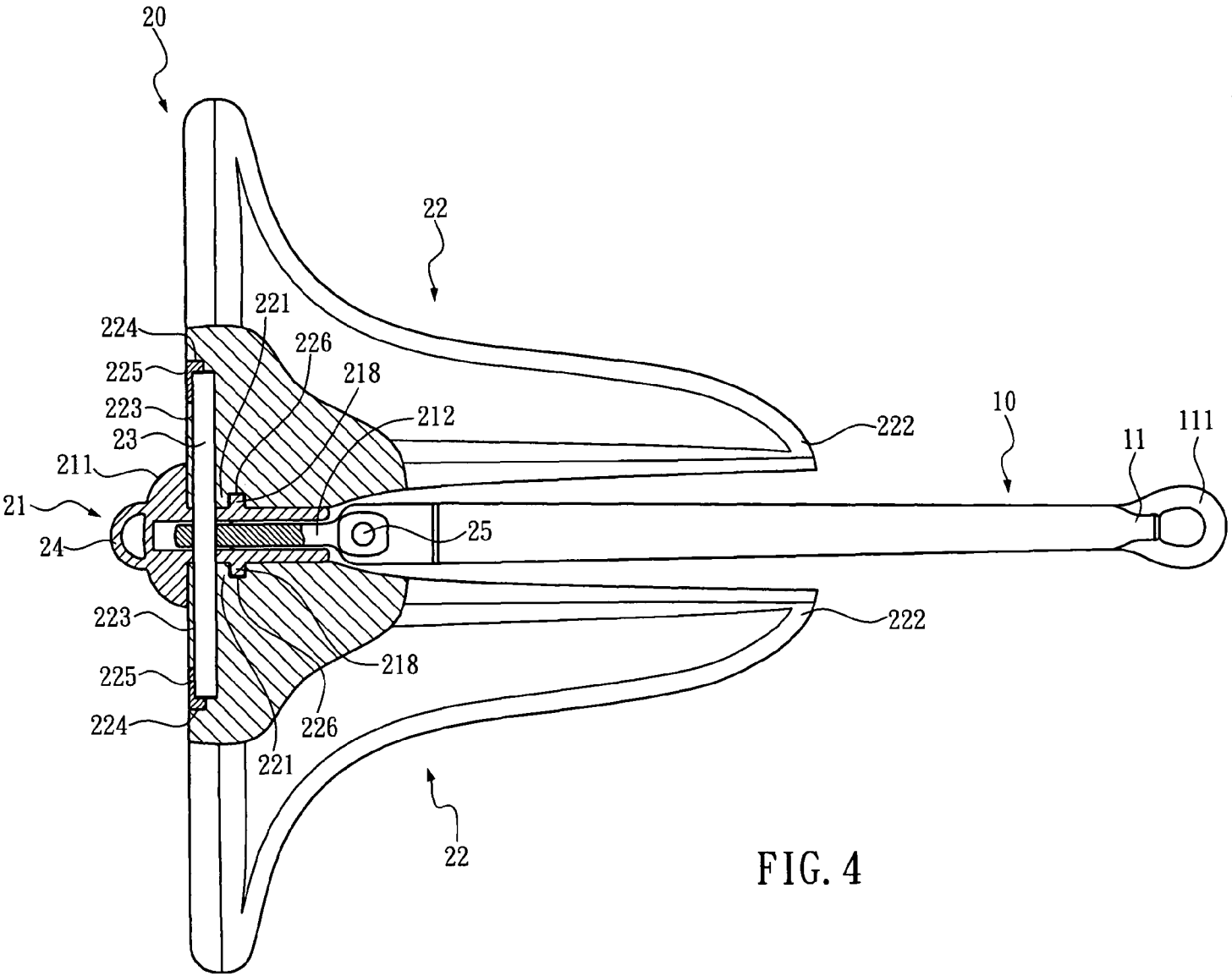
FIG. 4 is a schematic drawing of the assembled anchor shank and dual-fin fluke set.

Upon anchoring a vessel, after the anchor shank 10 and the dual-fin fluke set 20 are dropped into water and dragged against the ground, the dual-fin fluke set 20 and the anchor shank 10 are postured as shown in FIGS. 2 and 3. The two fins 22 have their inserting ends 222 biting into the ground so as to berth the vessel at the predetermined anchorage. The connector 21 has a connecting ring 24 to be connected with a weighing cable (not shown). When the weighing cable is hauled, the dual-fin fluke set 20 is departed from the ground and the vessel is unanchored.

Figure 5:
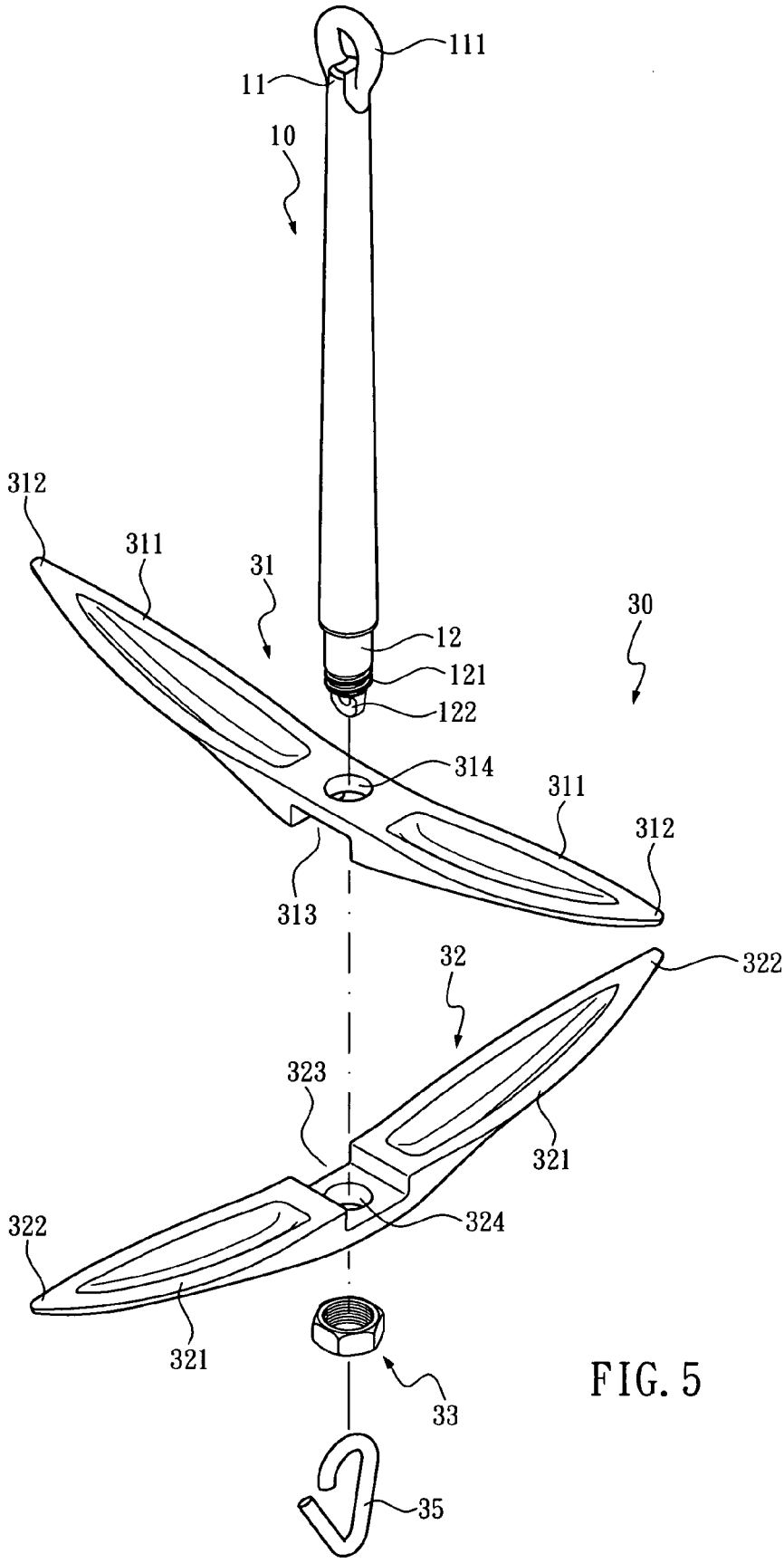
FIG. 5 is an exploded view of the anchor shank and a four-leaf fluke set according to the present invention.
Figure 7:
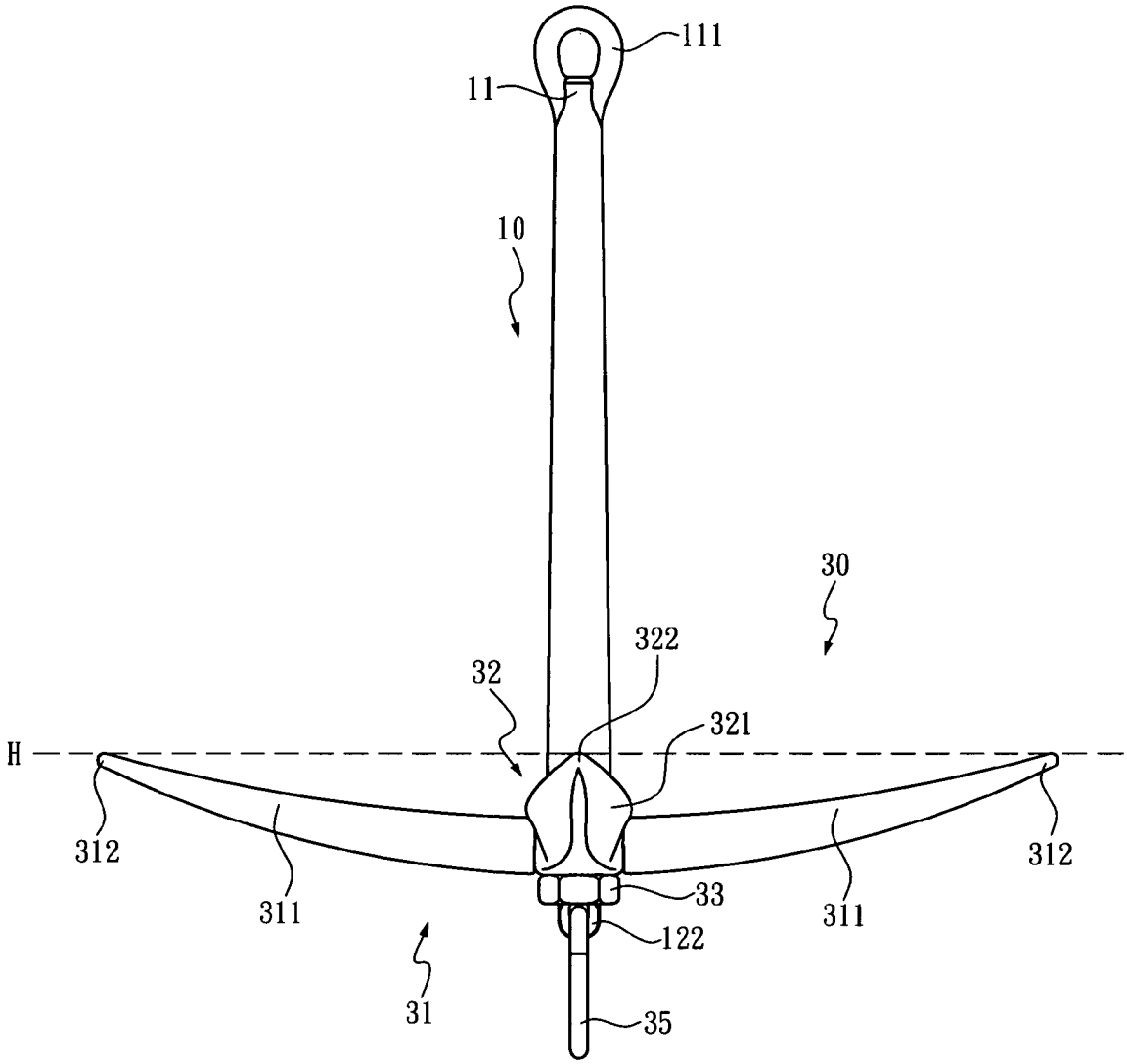
FIG. 7 is a lateral view of the assembled anchor shank and four-leaf fluke set.
Figure 8:
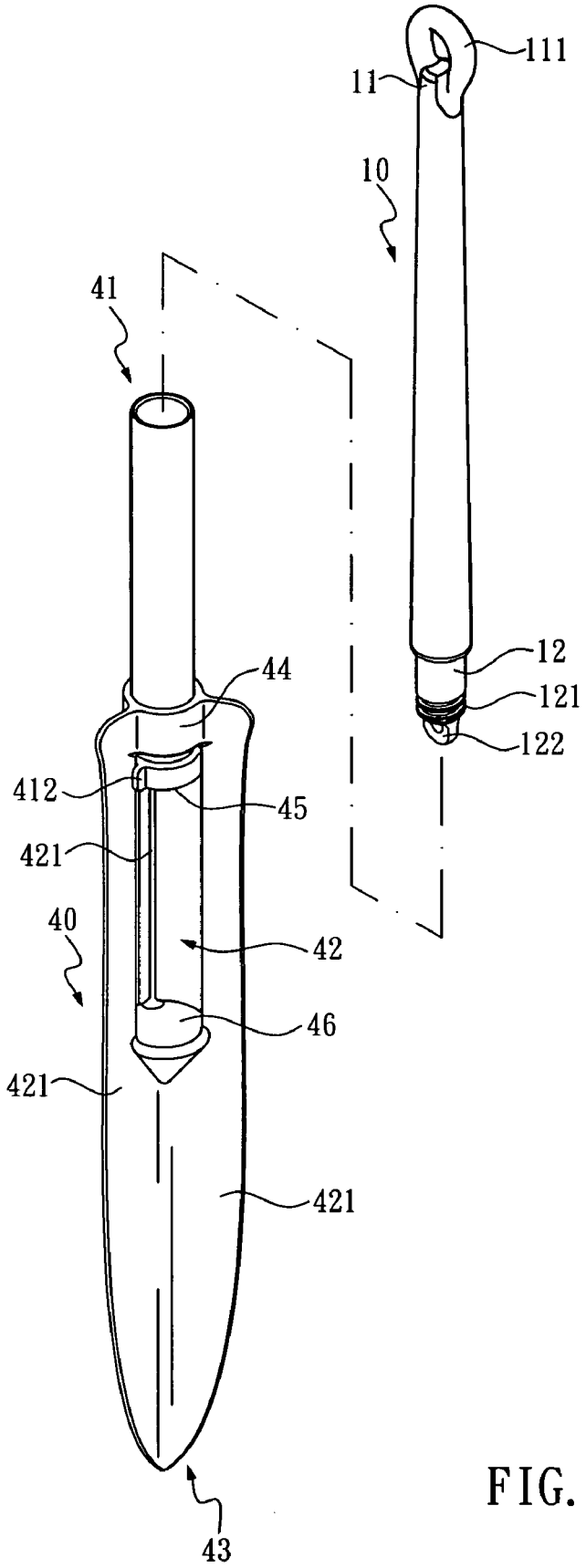
FIG. 8 is an exploded view of the anchor shank and a spear fluke set according to the present invention.

Reference is now made to FIGS. 5 through 7 wherein the four-leaf fluke set 30 is illustrated. Each of the first arm 31 and the second arm 32 has a curved body with two ends formed as claws 311, 321. The first arm 31 and the second arm 32 are intercrossed at centers thereof so that the claws 311, 321 are spaced apart 90 degrees and with tips 312, 322 being coplanar on a plane H as indicated by the dotted line in FIG. 7. The second end 12 of the anchor shank 10 passed through the intercrossed centers of the first arm 31 and the second arm 32 and then gets coupled with the assembling unit 33, so as to fix the first arm 31 and the second arm 32 to the second end 12 of the anchor shank 10.

Notches 313, 323 are formed at a bottom of the center of the first arm 31 and a top of the center of the second arm 32, respectively, so that when the first arm 31 and the second arm 32 are arranged perpendicular to each other, the two notches 313, 323 help the centers of the arms to engage with each other. Besides, through holes 314, 324 are formed at the centers of the first arm 31 and the second arm 32, respectively, for allowing the second end 12 of the anchor shank 10 to pass and combine with the assembling unit 33. The assembling unit 33 in the present embodiment is a nut to be coupled with the threaded portion 121 of the anchor shank 10, thereby fixing the first arm 31 and the second arm 32 to the second end 12 of the anchor shank 10. A connecting hook 35 is connected to the second connecting ring 122 of the anchor shank 10 and is connected to a weighing cable.

The four-leaf fluke set 30 is suitable to rocky grounds. Upon anchoring a vessel, after the anchor shank 10 and the four-leaf fluke set 30 are dropped into water and dragged against the ground, the four-leaf fluke set 30 will keep rolling until the first arm 31 and the second arm 32 grapple or catch a rigid, immovable article (rock) of the ground so as to berth the vessel at the predetermined anchorage. When the weighing cable is hauled, the four-leaf fluke set 30 pulled upward by the weighing cable through the connecting hook 35 and is thus departed from the ground, thereby unanchoring the vessel.

Referring to FIGS. 8 through 11, the spear fluke set 40 is the spear having plural edges 421 that are radially arranged. Each of the edges 421 has its width gradually reduced toward a tip of the spear and thus an inserting end 43 is formed at the tip of the spear fluke set 40. The assembling unit 41 settled at an axis of the spear fluke set 40 is a column-shaped component with a first end and a second end that are axially opposite. The first end includes a threaded portion 411 to be coupled with the threaded portion 121 of the anchor shank 10. The second end has retaining blocks 412 raising from a periphery thereof to retain the edges 421 so that the assembling unit 41 and the spear fluke set 40 are secured from relative rotation.

The spear fluke set 40 has an accommodating portion 42 formed along the axis and extending half the length of the spear fluke set 40. The accommodating portion 42 allows the assembling unit 41 to reciprocate therein. One end of the spear fluke set 40 opposite to the tip is provided with a retaining portion 44 so that when the assembling unit 41 moves upward to a limit, the retaining portion 44 serves to retain the retaining blocks 412, thereby preventing the assembling unit 41 from leaving the spear fluke set 40. A beater 45 is formed at a bottom of the assembling unit 41 and a pad portion 46 is formed at a bottom of the accommodating portion 42. Thus, when the assembling unit 41 moves downward, the beater 45 impacts the pad portion 46.

The spear fluke set 40 is suitable to the sandy coasts. Upon anchoring a vessel, the spear fluke set 40 has its inserting end 43 insets into the ground. Then an operator repeatedly lifts and press the anchor shank to make the assembling unit 41 hammer the pad portion 46, thereby inserting the spear fluke set 40 deeper to the sandy ground to a predetermined depth. Thus, the vessel is berthed on the sandy ground. To unanchor the vessel, the operator can easily pull the spear fluke set 40 upward to make it separate from the sandy ground.

To sum up, the present invention implements a single anchor shank 10 to work with the dual-fin fluke set 20, the four-leaf fluke set 30, or the spear fluke set 40 so that a user can choose one of the fluke sets that suits current anchoring conditions to assembled with the anchor shank 10. The anchor shank 10 is provided with the threaded portion 121 and thus facilitates the user's operation of changing among the fluke sets.

What is claimed is:

1. A multifunction anchor, comprising:

an anchor shank, having a first end and a second end positioned opposite at an axis of the anchor shank, wherein the first end comprises a first connecting ring while the second end is formed as a reduced-diameter section and comprises a second connecting ring fixed to a center of the second end, and a fluke set, having an assembling unit fixedly attached to the second end of the anchor shank and having a fluke body attached to the assembling unit wherein the fluke set is a dual-fin fluke set and the fluke body comprises two fins connected to two sides of the assembling unit and wherein the assembling unit comprises a connector and a connecting shaft that are pivotally connected with each other, the connecting shaft having a first end and a second end positioned opposite at an axis of the connecting shaft, and the first end of the connecting shaft being coupled with the second end of the shank in a screwed manner and the second end of the connecting shaft being connected with the base.

2. The multifunction anchor of claim 1 wherein the connector has a left portion and a right portion while the second end of the connecting shaft having a radially extending through hole is sandwiched between the left portion and the right portion so that a pin passes through the left portion, the through hole and the right portion.

3. The multifunction anchor of claim 2, wherein each of the two fins includes a base portion and a pin hole that is provided at the base portion for receiving a corresponding end of the pin whereby the corners are positioned in the left portion and the right portion of the base.

4. The multifunction anchor of claim 3, wherein an opening is formed at a side of the fin corresponding to the pin hole to be filled with a packing element so that the packing element presses against a periphery of the pin.

5. The multifunction anchor of claim 3, wherein each of the left portion and the right portion of the connector has a recess for receiving the base portion of the corresponding fin.

6. The multifunction anchor of claim 5, wherein the recess and the base portion are provided with a protrusion and a notch, respectively, the protrusion and the notch being designed to couple with each other.

7. The multifunction anchor of claim 1 wherein the connector has a connecting ring to be connected with a weighing cable.

8. A multifunction anchor, comprising:

an anchor shank, having a first end and a second end positioned opposite at an axis of the anchor shank, wherein the first end comprises a first connecting ring while the second end is formed as a reduced-diameter section and comprises a second connecting ring fixed to a center of the second end, and a fluke set, having an assembling unit fixedly attached to the second end of the anchor shank and having a fluke body attached to the assembling unit wherein the fluke set is a four-leaf fluke set, and the fluke body comprises a first arm and a second arm fixed to the second end of the anchor shank by the assembling unit wherein the first arm and the second arm each having a curved body are intercrossed at centers thereof so that when the first arm and the second arm are arranged perpendicular to each other, ends of the first arm and the second arm are coplanaer, and then the second end of the shank passes through holes formed at the centers of the first arm and the second arm to couple with the assembling unit in the screwed manner wherein notches are formed at a bottom of the center of the first arm and a top of the center of the second arm, respectively, so that when the first arm and the second arm are arranged perpendicular to each other, the two notches help the centers of the arms to engage with each other.

9. A multifunction anchor, comprising:

an anchor shank, having a first end and a second end positioned opposite at an axis of the anchor shank, wherein the first end comprises a first connecting ring while the second end is formed as a reduced-diameter section and comprises a second connecting ring fixed to a center of the second end, and a fluke set, having an assembling unit fixedly attached to the second end of the anchor shank and having a fluke body attached to the assembling unit wherein the fluke set is a spear fluke set, and the fluke body comprises a plurality of edges that are radially arranged, in which an inserting end is formed at a tip of the spear fluke set and wherein the assembling unit settled at an axis of the spear fluke set is a column-shaped component with a first end and a second end that are axially opposite, the first end of the assembling unit and the second end of the shank being coupled with each other in the screwed manner.

10. The multifunction anchor of claim 9 wherein the spear fluke set has an accommodating portion formed along the axis and extending half the length of the spear fluke set to allow the assembling unit to reciprocate thereon.

11. The multifunction anchor of claim 10, wherein one end of the spear fluke set opposite to the tip is provided with a retaining portion and at least one retaining block is provided at a periphery of the assembling unit so that when the assembling unit moves upward to a limit, the retaining portion serves to retain the retaining block.

12. The multifunction anchor of claim 11, wherein a beater is formed at a bottom of the assembling unit and a pad portion is formed at a bottom of the accommodating portion so that when the assembling unit moves downward, the beater impacts the pad portion.

* * * * *